US010716406B2

(12) United States Patent
Koltzenburg

(10) Patent No.: US 10,716,406 B2
(45) Date of Patent: Jul. 21, 2020

(54) DRIVE FOR ADJUSTING PARTS OF SEATING AND LYING FURNITURE

(71) Applicant: DewertOkin GmbH, Kirchlengern (DE)

(72) Inventor: Sascha Koltzenburg, Preußisch Oldendorf (DE)

(73) Assignee: DewertOkin GmbH, Kirchlengern (DE)

( * ) Notice: Subject to any disclaimer, the term of this patent is extended or adjusted under 35 U.S.C. 154(b) by 0 days.

(21) Appl. No.: 16/315,623

(22) PCT Filed: Jul. 24, 2017

(86) PCT No.: PCT/EP2017/068672
§ 371 (c)(1),
(2) Date: Jan. 4, 2019

(87) PCT Pub. No.: WO2080/019784
PCT Pub. Date: Feb. 1, 2018

(65) Prior Publication Data

US 2019/0254436 A1 Aug. 22, 2019

(30) Foreign Application Priority Data

Jul. 29, 2016 (DE) ..... 20 2016 104 185 U

(51) Int. Cl.
*A47C 20/04* (2006.01)

(52) U.S. Cl.
CPC ..... *A47C 20/041* (2013.01)

(58) Field of Classification Search
CPC ..... A47C 20/041; F16H 25/20; F16H 2025/2031
See application file for complete search history.

(56) References Cited

U.S. PATENT DOCUMENTS 3,644,946 A * 2/1972 Swatt ..... A47C 20/041 5/616
4,449,263 A * 5/1984 Wilson ..... A47C 17/40 5/133

(Continued)

FOREIGN PATENT DOCUMENTS

DE 202005006571 U1 9/2006

OTHER PUBLICATIONS

Int'l Search Report dated Oct. 17, 2017 in Int'l Application No. PCT/EP2017/068672.

*Primary Examiner* — David M Fenstermacher
(74) *Attorney, Agent, or Firm* — Panitch Schwarze Belisario & Nadel LLP

(57) ABSTRACT

A drive for adjusting parts of seating and lying furniture, wherein a first furniture component is mounted moveably relative to a second furniture component, includes at least one spindle rotatable by an electric motor. An adjusting nut is carried on the spindle, is guided non-rotatably in a guide tube, and is drivable by rotation of the spindle in the axial direction of the guide tube. A lift tube is operatively connected to the adjusting nut. A first pivotal connecting device is arranged at the free end of the lift tube and may be pivotally connected to the first furniture component by way of a first hinge connection. A second pivotal connecting device is provided at the opposite end of the drive and can be fixed by way of a second hinge connection to a stationary frame portion or to a second furniture component.

16 Claims, 13 Drawing Sheets

(56) References Cited

U.S. PATENT DOCUMENTS

Figure 1:
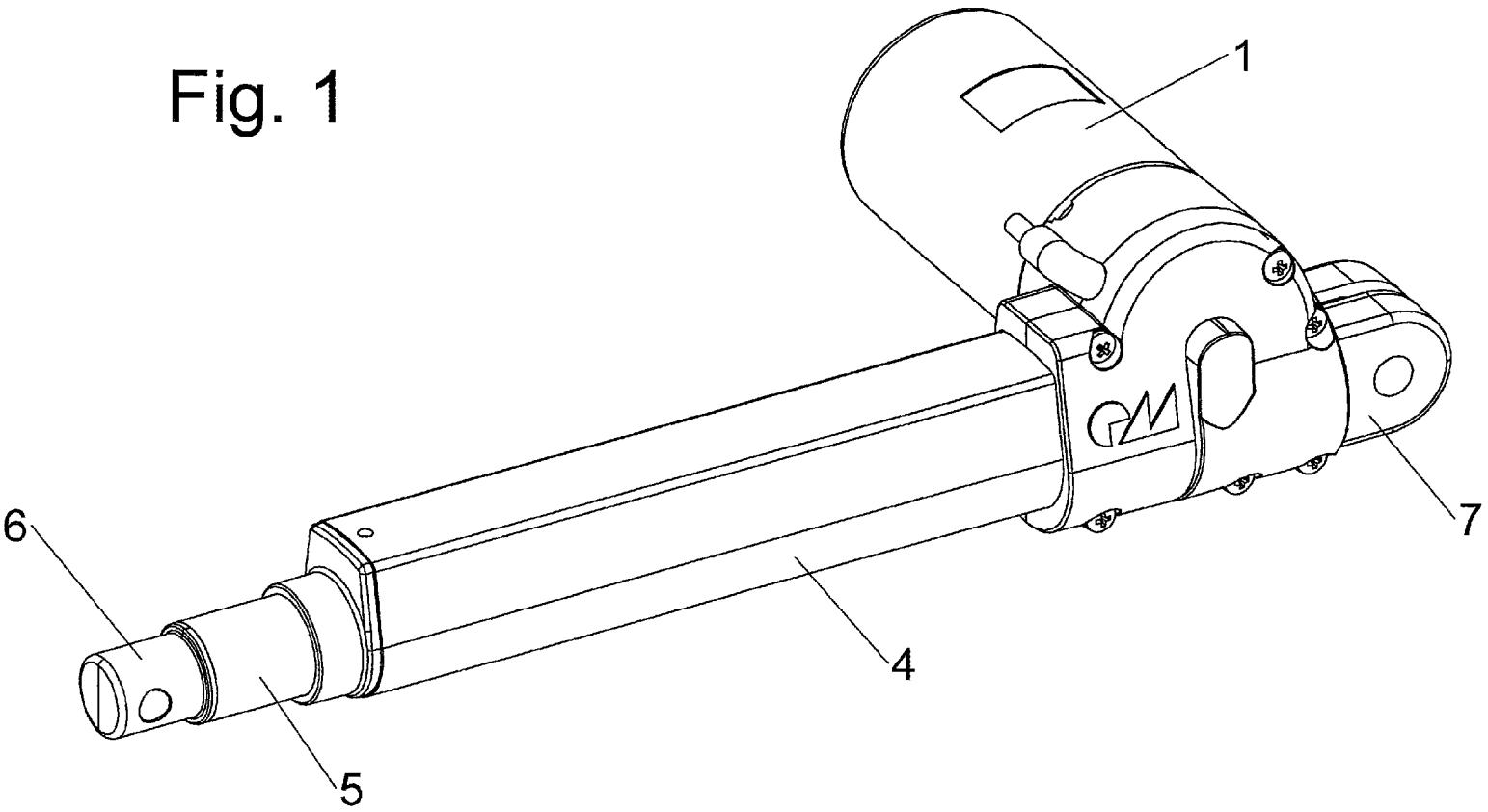

| | | | | |
|---|---|---|---|---|
| 5,927,144 | A * | 7/1999 | Koch | A47C 20/041<br>297/330 |
| 6,378,671 | B1 * | 4/2002 | Carlson | B62D 5/006<br>188/267.2 |
| 7,240,385 | B1 * | 7/2007 | Brown | A47C 20/022<br>5/617 |
| RE43,193 | E * | 2/2012 | Osborne | A47C 19/045<br>5/600 |
| 9,958,108 | B2 * | 5/2018 | Bowman | F16M 11/18 |
| 2009/0094748 | A1 | 4/2009 | Long | |
| 2010/0064830 | A1 | 3/2010 | Zeng | |

* cited by examiner

DRIVE FOR ADJUSTING PARTS OF SEATING AND LYING FURNITURE

CROSS-REFERENCE TO RELATED APPLICATIONS

This application is a Section 371 of International Application No. PCT/EP2017/068672, filed Jul. 24, 2017, which was published in the German language on Feb. 1, 2018 under International Publication No. WO 2018/019784 A1, which claims priority under 35 U.S.C. § 119 to German Patent Application No. 20 2016 104 185.6, filed on Jul. 29, 2016; the disclosures of which are incorporated herein by reference.

The invention concerns a drive for adjusting parts of seating and lying furniture, wherein a first furniture component is mounted moveably relative to a second furniture component, comprising at least one spindle rotatable by way of an electric drive motor, an adjusting nut which is carried on the spindle and which is guided non-rotatably in a guide tube and which is drivable by rotation of the spindle in the axial direction of the guide tube, a lift tube operatively connected to the adjusting nut, a first pivotal connecting device which is arranged at the free end of the lift tube and which can be pivotally connected to the first furniture component by way of a first hinge connection, and a second pivotal connecting device which is provided at the opposite end of the adjusting drive and which can be fixed by way of a second hinge connection to a stationary frame portion or to a second furniture component.

Adjusting drives of the specified kind have long been known for seating and lying furniture and have proven themselves to be outstandingly good.

If however such a known adjusting drive is to be used for the movement kinematics for adjusting the head portion of beds, in particular sick beds, difficulties arise. The space available for the mechanism and for the drive of a head portion is extremely limited so that the known adjusting drive which is of a relatively long structure cannot be used because of the available space issue.

In order to obviate the space problem in regard to adjustment of a head portion it is necessary to use relatively expensive drives of a short structure.

Therefore the object of the present invention is to be able to use the adjusting drive which is described in the opening part of this specification and which is of a relatively long structure but which is uncomplicated, reliable and inexpensive, even for the movement mechanism for adjusting furniture components, when there is only a limited amount of space available.

According to the invention that object is attained in that provided at at least one of the two pivotal connecting devices is an extension element which is fixedly connected to same, a respective hinge half of the hinge connection is arranged at the extension element, and the hinge half which is carried at the respective extension element is displaced in the direction to the central portion of the guide tube.

The invention makes it possible to get round the space problem, which is achieved for example in the case of head portion adjustment, in that the dimension between the connecting pins in the retracted condition is relatively short. The invention provides that the adjusting drive described in the opening part of this specification can be very easily converted using minimal means so that, in spite of the prevailing space problem, it can be used in adjustment of the head portion.

Preferably the respective extension element is fixed to the pivotal connecting device in question.

A first variant provides that the extension element is fixedly connected indirectly or directly to the free end of the lift tube.

In that case the extension element can be in the form of a U-shaped loop, wherein the base of the loop can be connected indirectly or directly to the free end of the lift tube. The limbs of the U-shape of the loop extend in that case on both sides of the lift tube parallel to the lift tube while the hinge halves are arranged in the region of the free ends of the limbs of the U-shape. Accordingly the hinge half which serves for connection to the pivot fork of the pivot shaft is displaced in the direction towards the central region of the guide tube and thus the spacing between the corresponding hinge connections is reduced as desired.

The U-shaped loop can be in the form of a stable, multi-ribbed plastic portion or a cast metal portion.

Alternatively the U-shaped loop can comprise bent steel plate.

In order to connect the U-shaped loop to the free end of the lift tube, a projection or pin can be provided, for example welded, at the inside surface of the base of the U-shaped loop, the projection serving as a connecting element.

In another embodiment a tubular projection can be provided at the outside surface of the U-shaped loop around an opening in the base of the U-shaped loop, for example being welded thereto, the projection being fitted indirectly or directly on to the free end of the lift tube and fixed thereto.

In another embodiment the U-shaped loop can be formed from two halves on which half-shell portions are shaped, so that the half-shell portions can be indirectly or directly screwed to the free end of the lift tube or can be fixed in some other fashion.

In a further embodiment the limbs of the U-shape of the U-shaped loop can be pivotable relative to the base about an axis extending transversely relative to the base so that the kinematics of the arrangement can be altered in that way.

In a further embodiment lateral projections can be provided at the limbs of the U-shaped loop, wherein the hinge halves are provided at the projections so that they are displaced out of the plane of the limbs of the U-shape.

A further variant provides that the extension element is of a pot-shaped configuration, wherein the inside surface of the pot bottom can be indirectly or directly connected to the free end of the lift tube.

A further variant of the invention provides that a transverse yoke is fixed to the free end of the lift tube and a flexible cable is guided around the transverse yoke, the ends of which cable can be connected to the pivot fork of the pivot shaft (9).

A further embodiment of the invention provides that the extension element is arranged at the side of the adjusting drive, that is remote from the free end of the lift tube, wherein the dimension between the connecting pins can also be reduced in that way.

In this embodiment the extension element can be in the form of a U-shaped loop, the base of which is fixed to the pivotal connecting device while the limbs of the U-shape extend on both sides of the lift tube parallel thereto. In that case the hinge halves are desirably arranged in the region of the free ends of the limbs of the U-shape.

Finally there is also the possibility of arranging suitable extension elements at both ends of the adjusting drive at the pivotal connecting devices. That structure results in an extremely short distance between the pivotal connecting regions.

Each extension element involves a fixed connection to the adjusting drive. If the extension element in itself is of a rigid and thus unyielding nature and thus also does not have any flexible or articulated portions the adjusting drive which is connected thereto can transmit its adjusting force unrestrictedly in both directions of movement acting on the article of furniture or on the respective furniture component. Some articles of furniture for example for safety reasons require adjustment by motor force exclusively in one direction of movement. The return movement in the other direction is then effected by the force of gravity and/or or by spring force. In accordance with such a configuration of the adjusting drive, simple actuation of the lift tube is effected in the interior by virtue of the force-generating and movement-producing adjusting nut. While in the rest condition the adjusting nut remains stationarily on the spindle the lift tube has the option of moving away from the adjusting nut towards an inner end abutment. The lift tube can therefore move freely between the first limitation afforded by the adjusting nut and a second limitation. In other words, in contrast to the variant referred to in the opening part of this specification, wherein the adjusting nut and the lift tube involve a fixed connection, the end of the lift tube which is disposed in the adjusting drive is exclusively non-fixedly contacted by the adjusting nut and can be acted upon with the adjusting and holding force. At any event the adjusting nut is operatively connected to the lift tube insofar as the adjusting nut is either fixedly connected to the lift tube or involves a non-fixed contact therewith.

In principle the adjusting drive is adapted for the adjustment of furniture components relative to each other. Depending on the respective configuration of the article of furniture a portion of the adjusting drive either remains stationarily in position like for example at a fixed frame portion, or the adjusting drive is pivotable about a point or however the adjusting drive moves during the adjusting process, considered from a stationary point in space.

Figure 2:
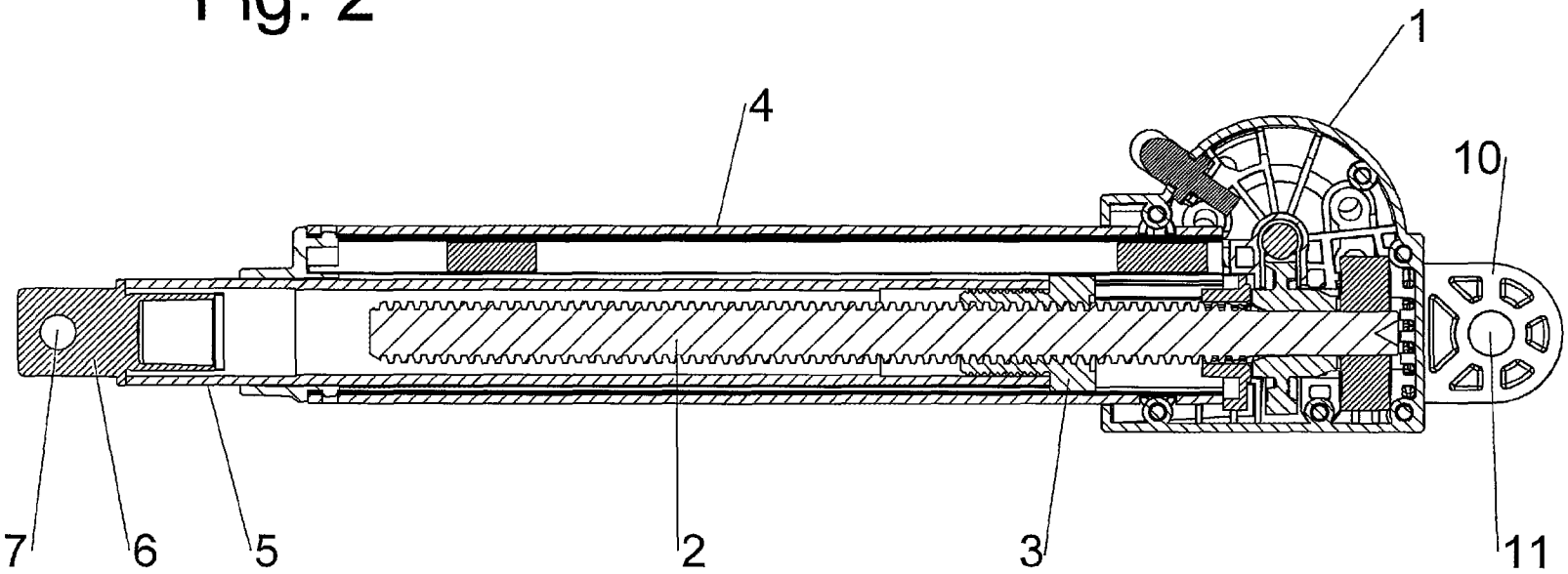
Figure 3:
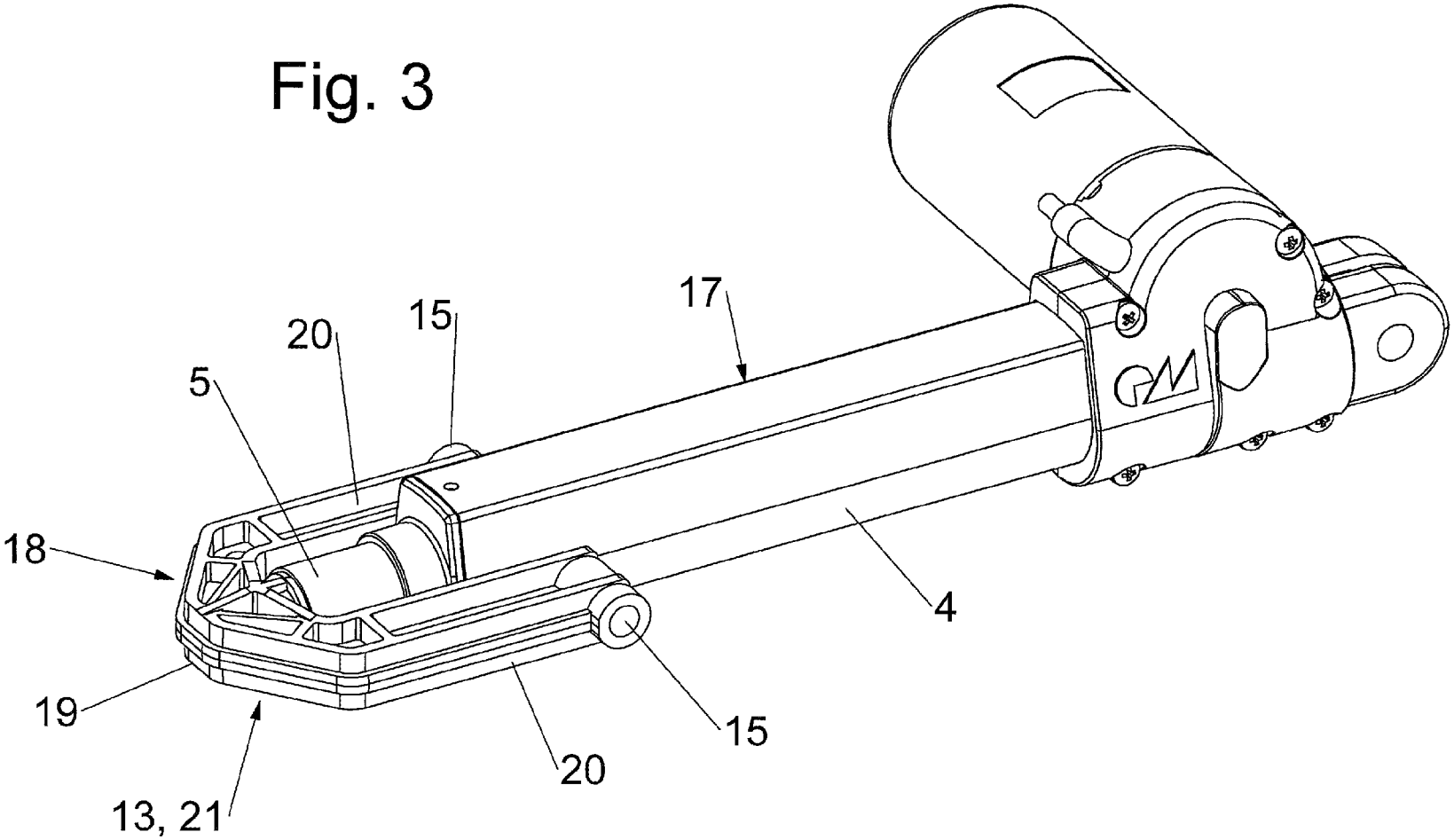
Figure 4:
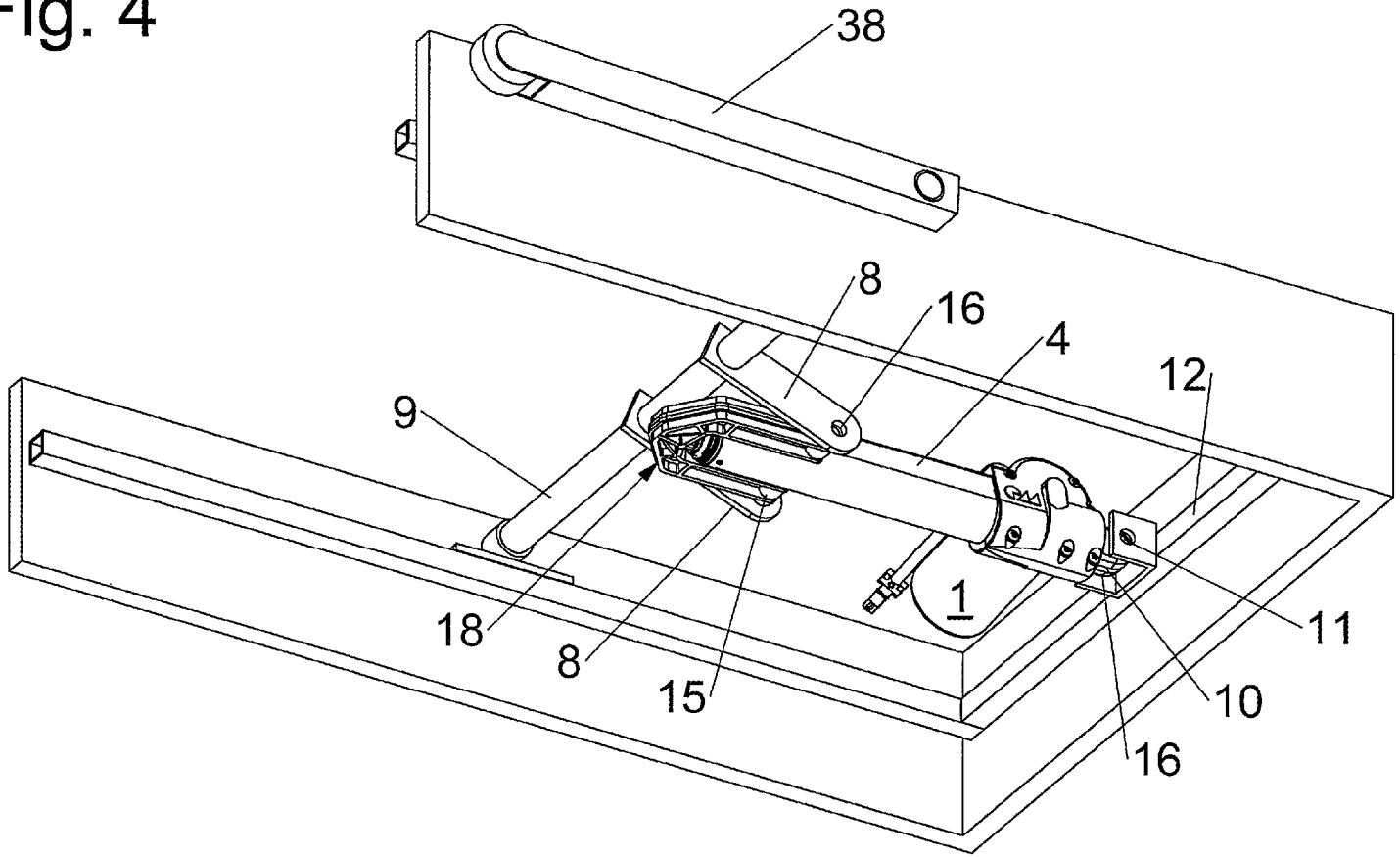
Figure 5:
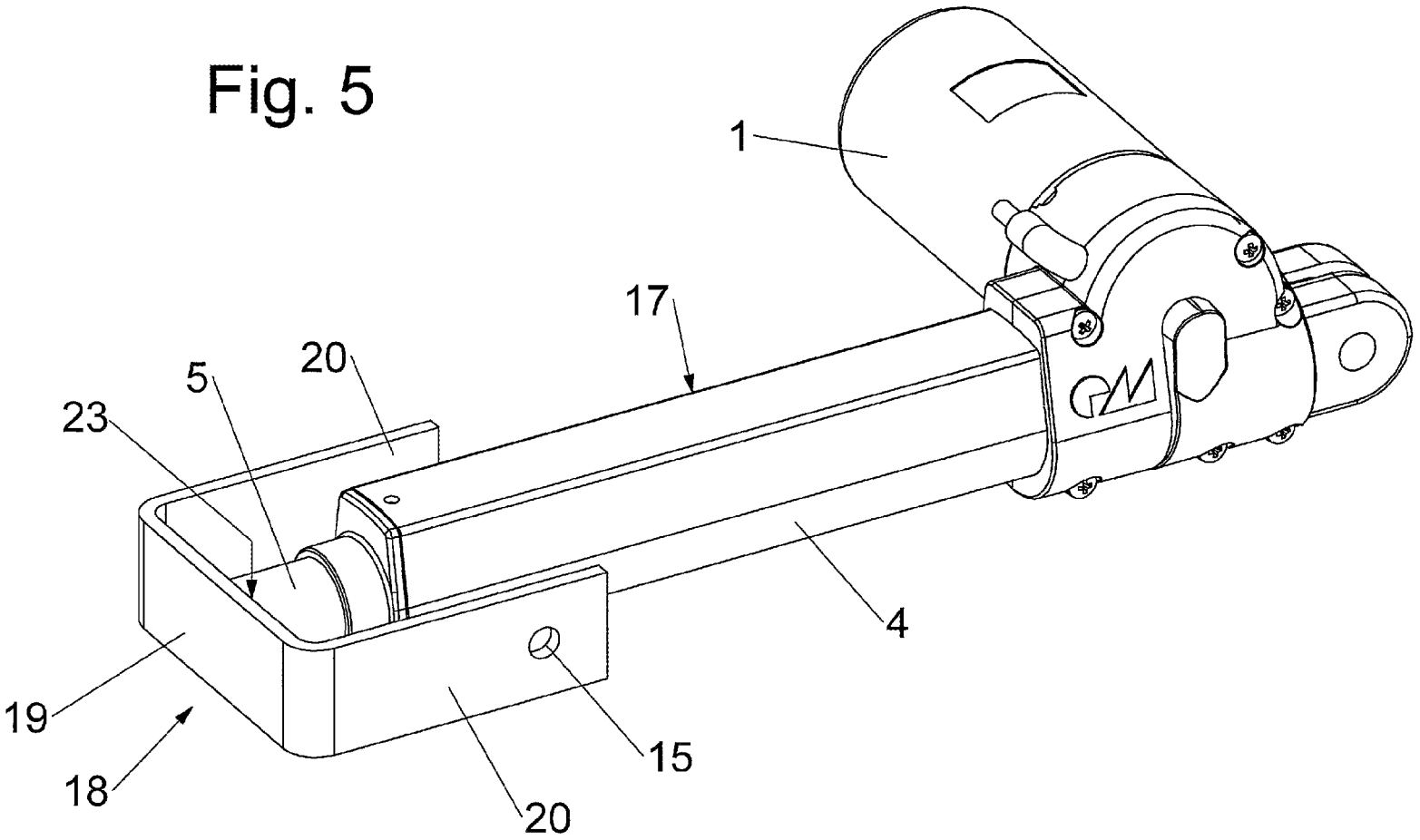
Figure 6:
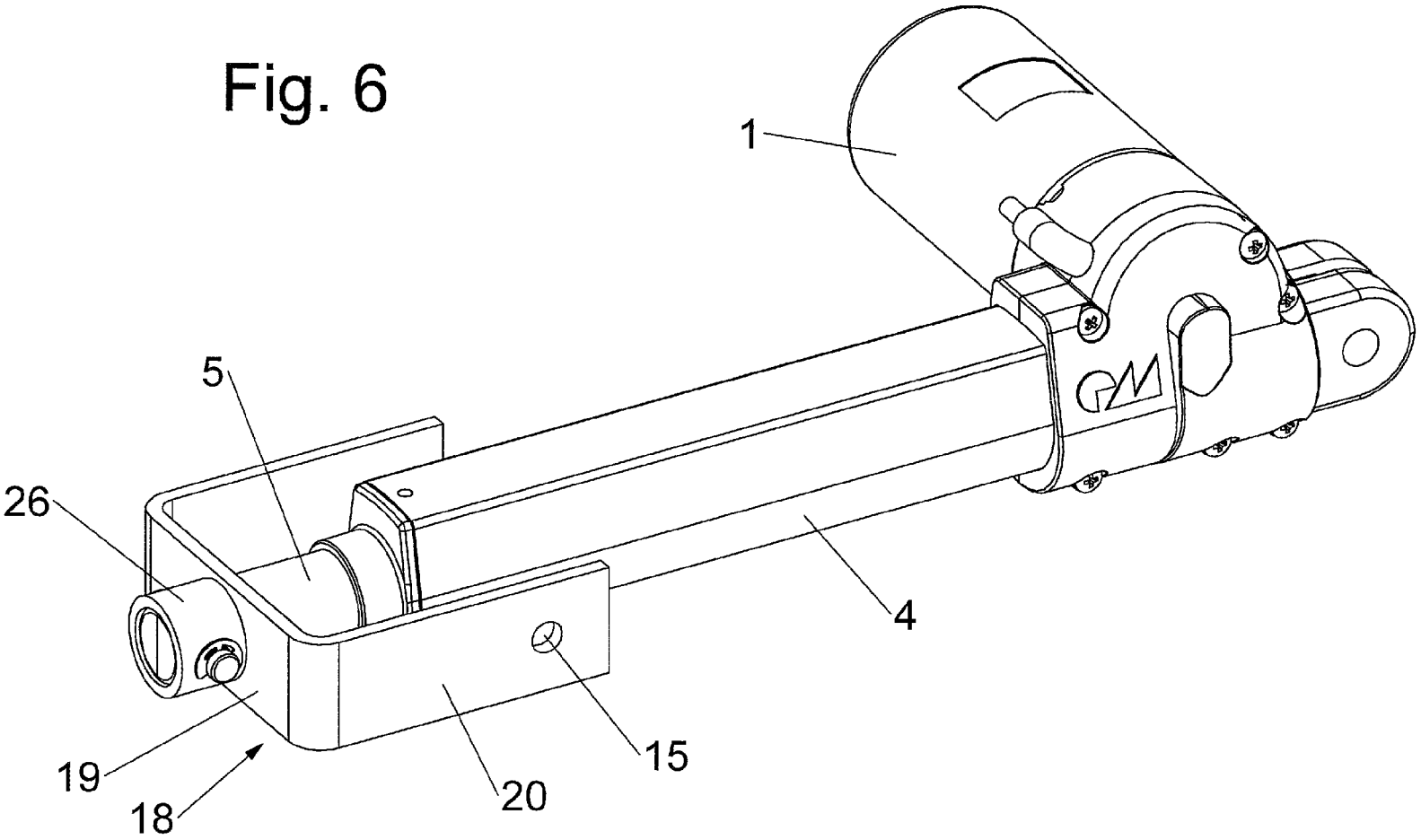
Figure 7:
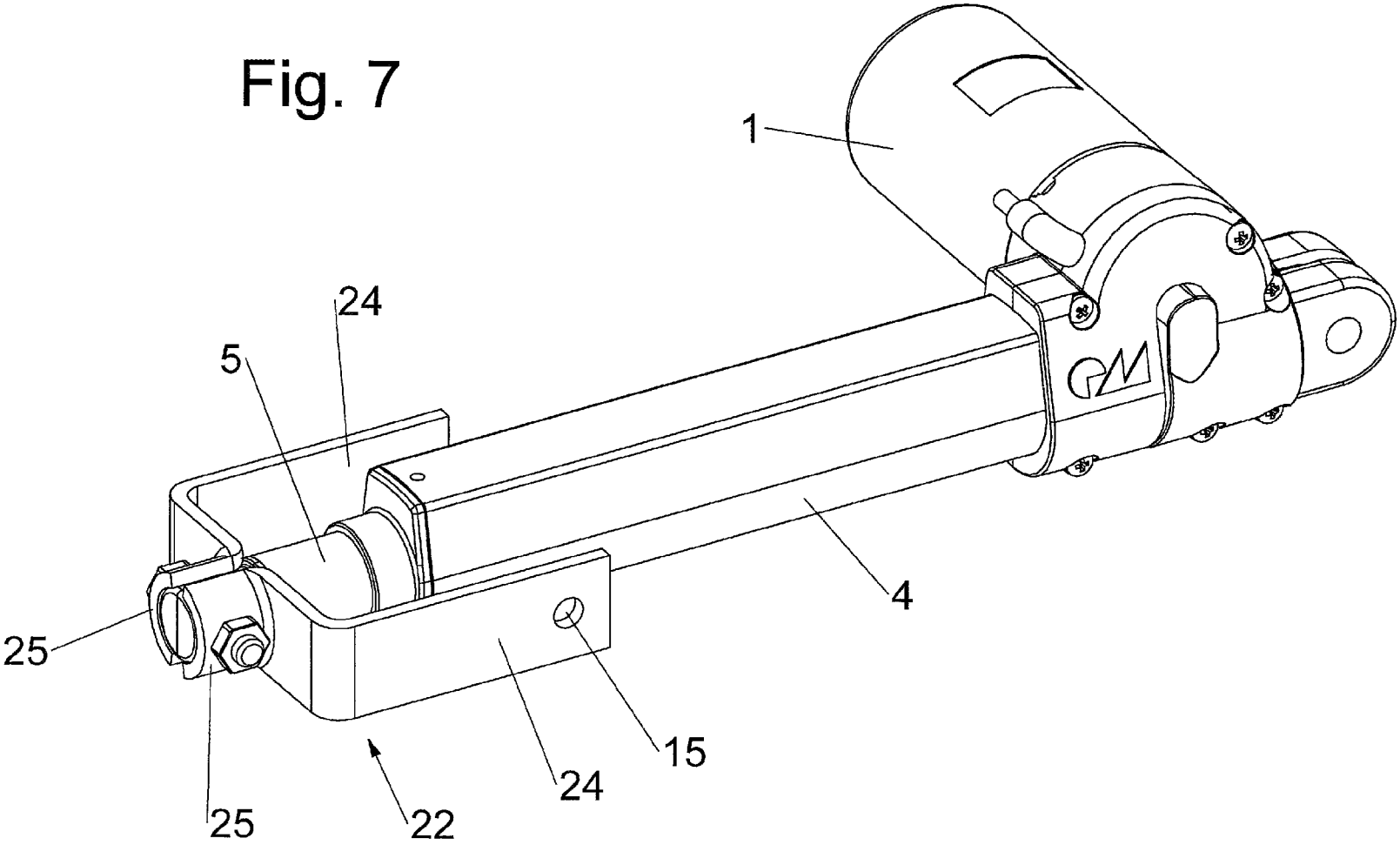
Figure 8:
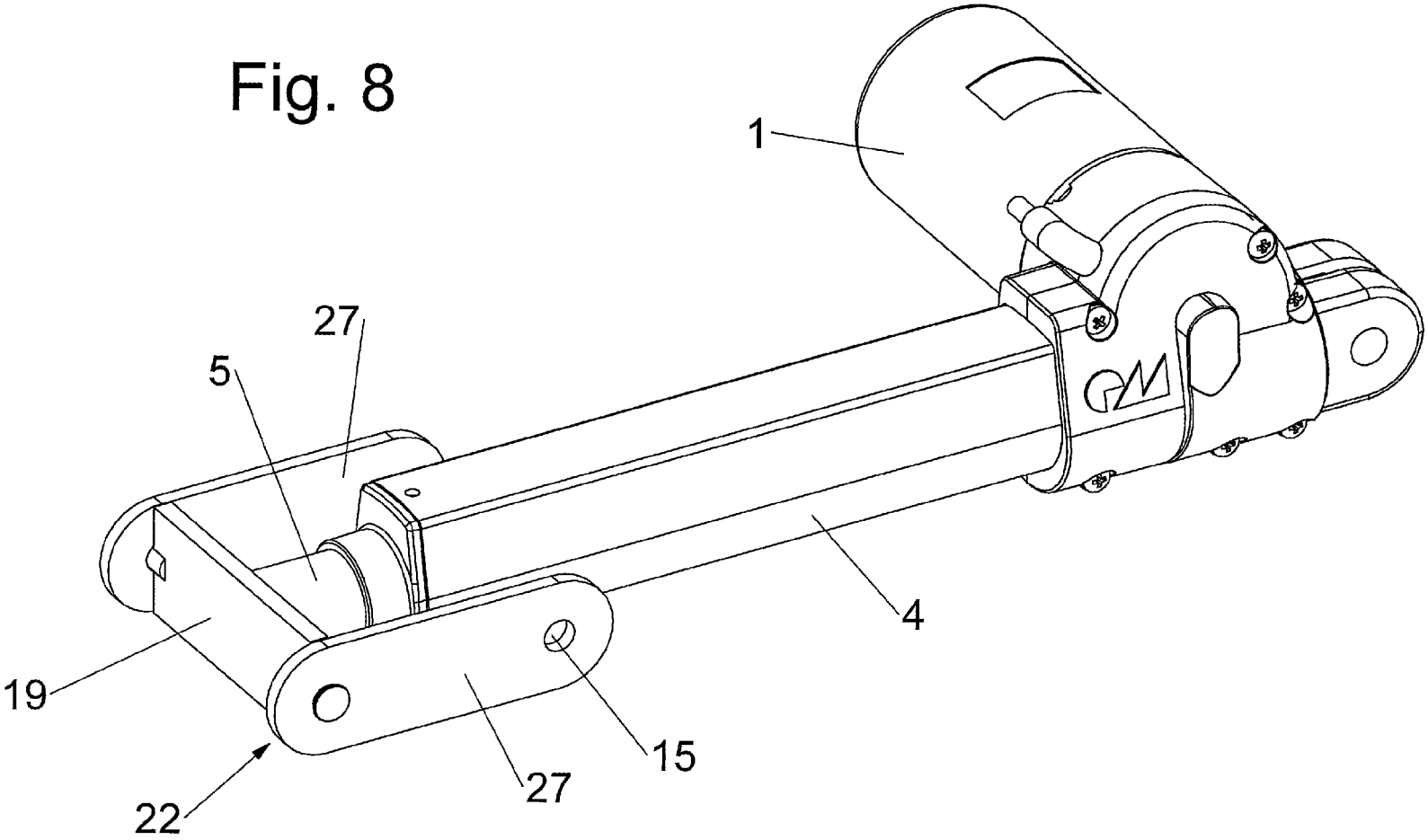
Figure 9:
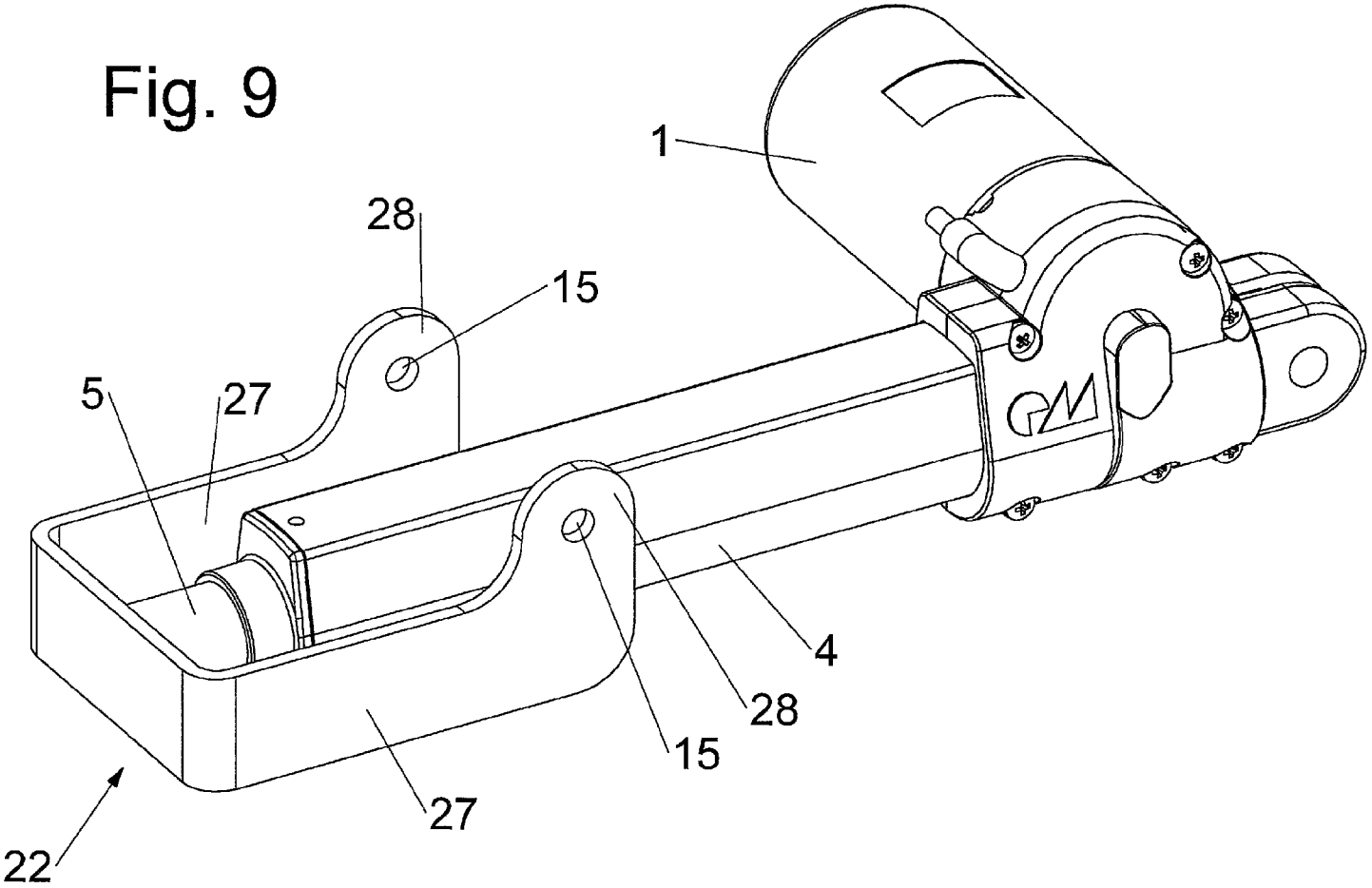
Figure 10:
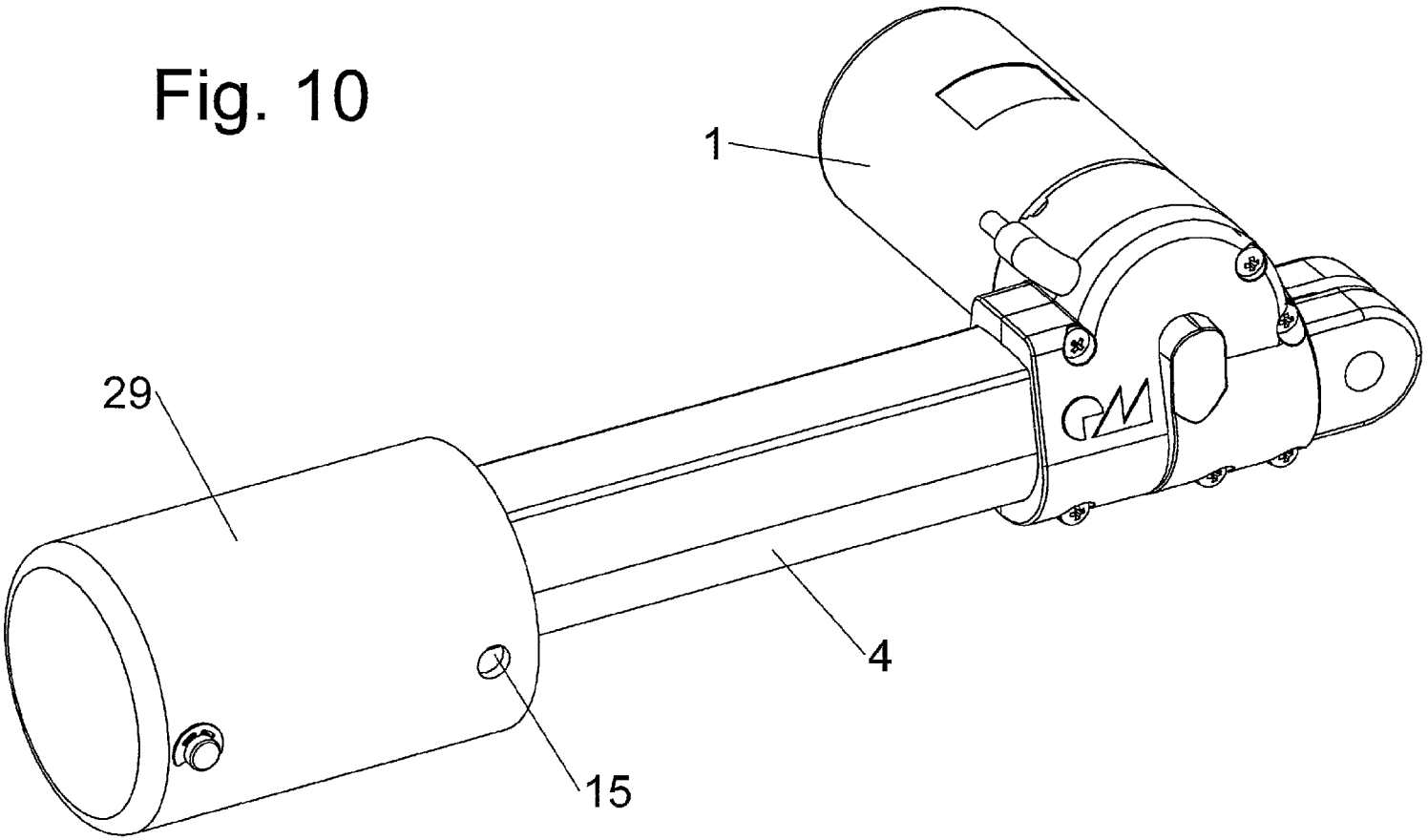
Figure 11:
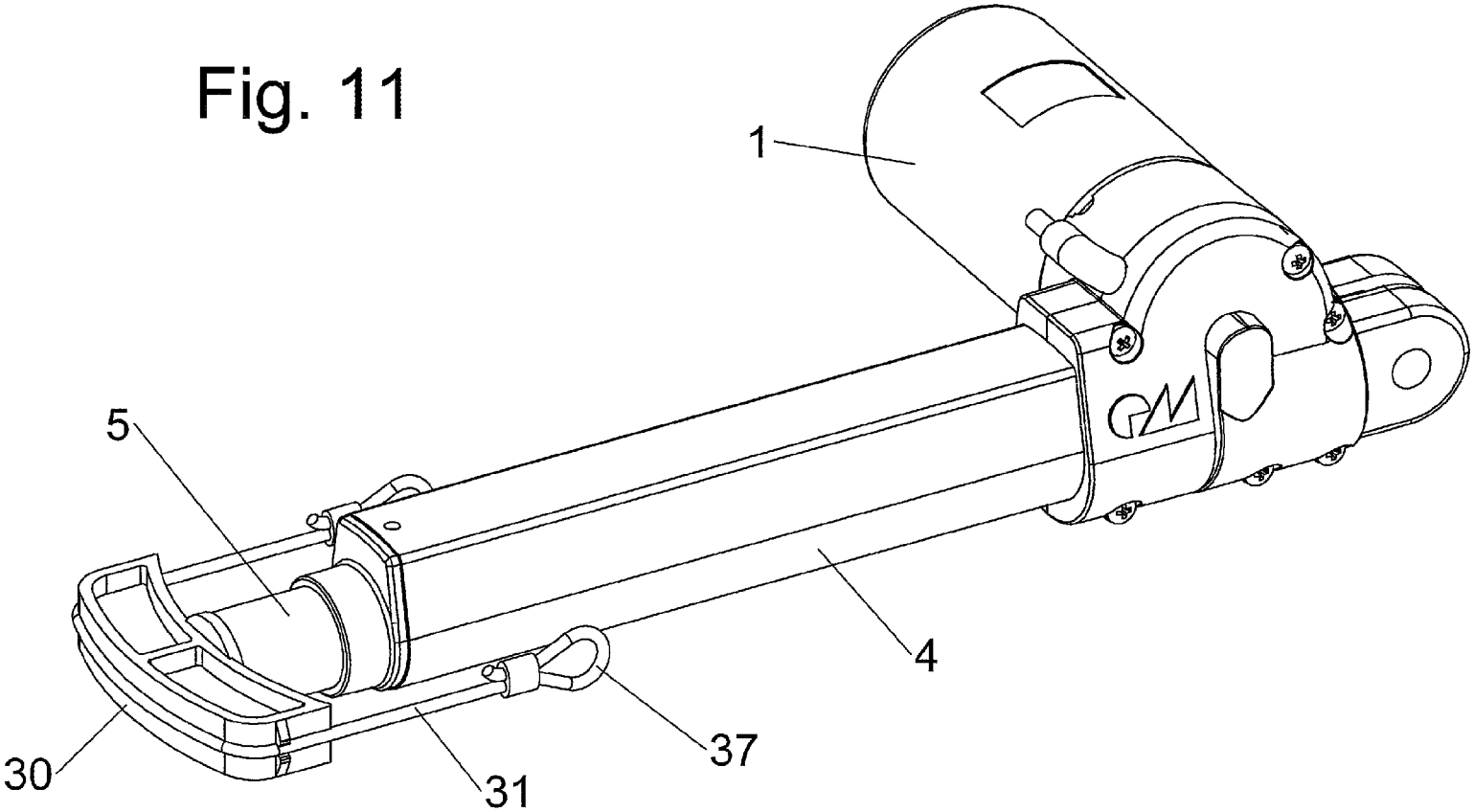
Figure 12:
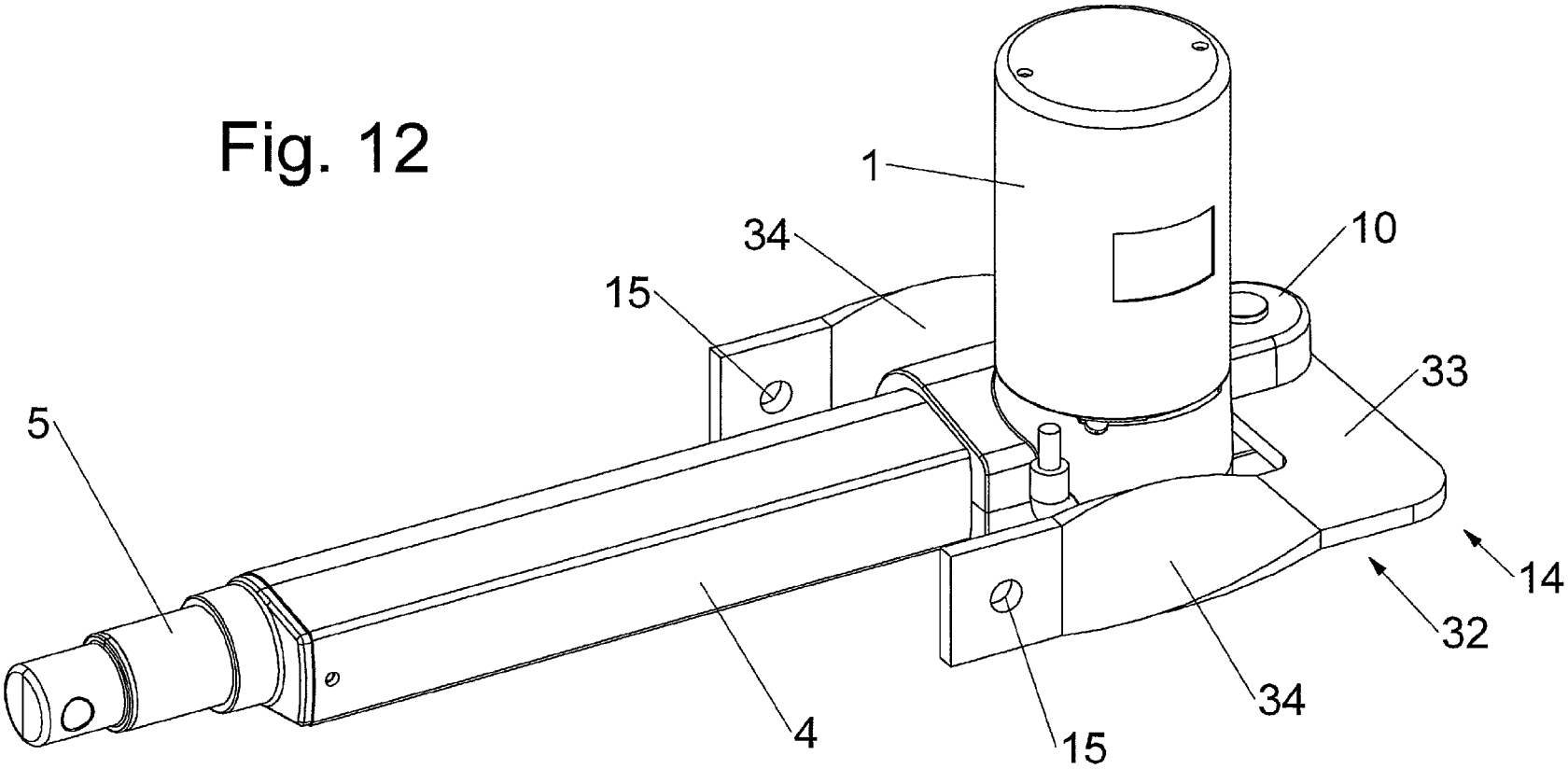
Figure 13:
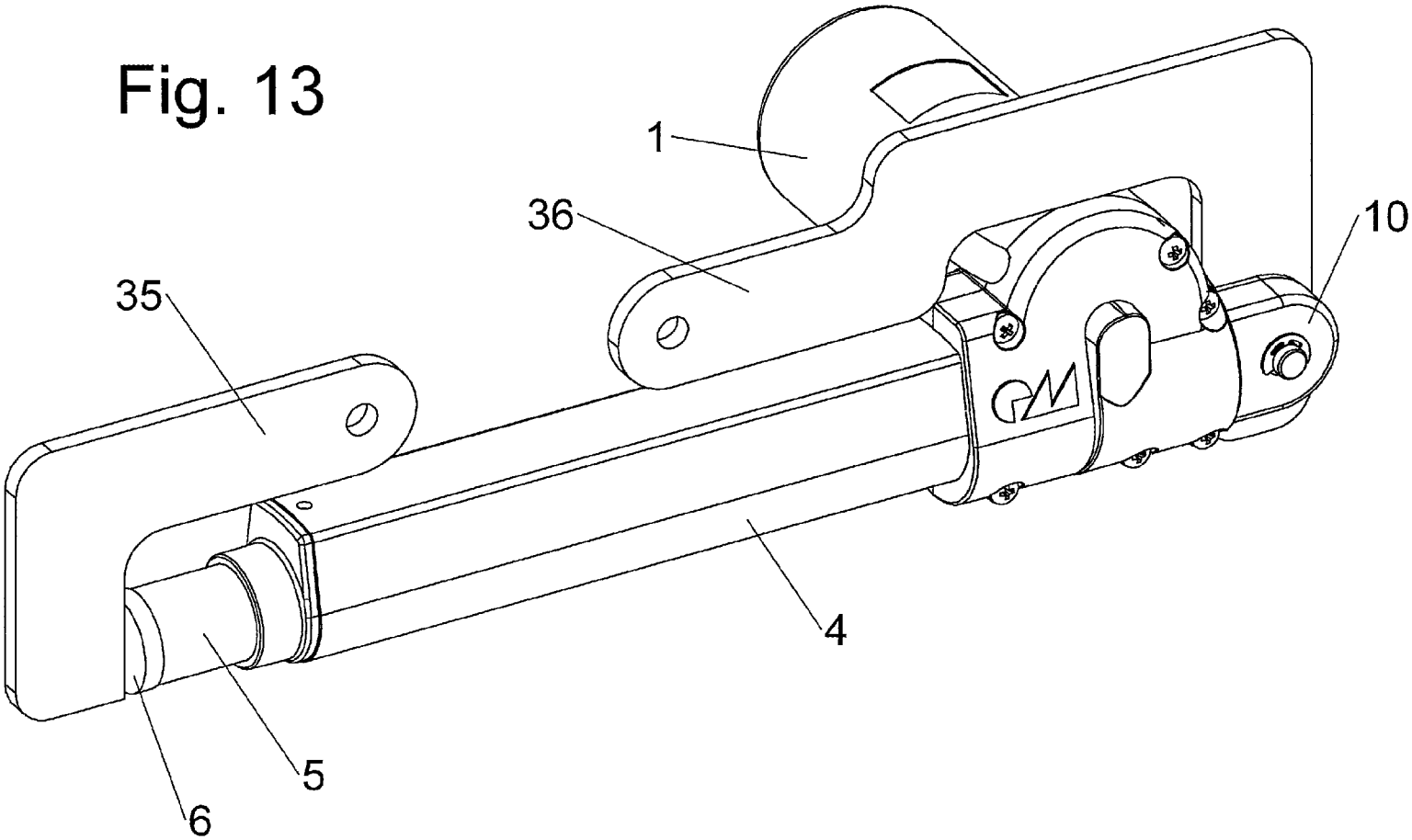

The invention is illustrated by way of example in the drawing and is described hereinafter in detail with reference to the drawing in which:

FIG. 1 shows a perspective view of a conventional adjusting drive,

FIG. 2 shows a longitudinal section through the adjusting drive of FIG. 1, FIG. 3 shows a first embodiment of the invention, FIG. 4 shows the application of the embodiment of FIG. 3 in relation to adjustment of the head portion of a bed, FIG. 5 shows a second embodiment of the invention, FIG. 6 shows a third embodiment of the invention, FIG. 7 shows a fourth embodiment of the invention, FIG. 8 shows a fifth embodiment of the invention, FIG. 9 shows a sixth embodiment of the invention, FIG. 10 shows a seventh embodiment of the invention, FIG. 11 shows a eighth embodiment of the invention, FIG. 12 shows a ninth embodiment of the invention, and FIG. 13 shows a tenth embodiment of the invention.

Referring to FIGS. 1 and 2 of the description the per se known adjusting drive which serves for adjusting portions of seating and lying furniture comprises an electric drive motor 1, a rotatably mounted threaded spindle 2 drivable by the drive motor 1, an adjusting nut 3 which is carried on the threaded spindle 2 and which is guided non-rotatably in a guide tube 4 and is drivable by rotation of the threaded spindle 2 in the axial direction of the guide tube 4. There is also a lift tube 5 which is connected to the adjusting nut 3, and at the free end of which is provided a first pivotal connecting device 6 in the form of a fork head, which can be pivotally connected by way of a first hinge connection 7 to the pivot fork 8 of a pivot shaft 9, as can be seen from FIG. 4.

In addition provided at the motor end of the adjusting drive is a second pivotal connecting device 10 in the form of a fork head which can be fixed by way of a hinge connection 11 to a stationary frame portion 12 of the article of furniture, as shown in the view in FIG. 4.

In the first embodiment of the invention shown in FIG. 3 an extension element 13 is fixed rigidly to the pivotal connecting device 6 or to the free end of the lift tube 5 respectively. Fixing of the extension element 13 can be effected in various ways.

In this case the extension element 13 is in the form of a U-shaped loop 18 whose base 19 is fixed to the end of the lift tube 5. The limbs 20 of the U-shape of the loop 18 extend on both sides of the lift tube 5 parallel thereto, the hinge halves 15 being arranged in the region of the free ends of the limbs 20. By virtue of the fact that the limbs 20 are arranged parallel to the lift tube 5 this arrangement predetermines a direction of force which is precisely on the longitudinal axis of the lift tube 5.

In the embodiment shown in FIG. 3 the U-shaped loop 18 is in the form of a stable, multi-ribbed plastic portion or cast metal portion 21, wherein the ribs are connected together in highly stable relationship by transverse strut means.

FIG. 4 illustrates an example of installation for the adjusting drive shown in FIG. 3. For reasons of clarity of the drawing only a part of a bed frame is shown, more specifically inclinedly from below.

As can be seen in detail from FIG. 4 the hinge halves 15 of the U-shaped loop are in engagement with corresponding hinge halves 16 provided on the pivot fork 8. The pivot fork 8 serves for pivotal movement of a pivot shaft 9, with which corresponding actuating arms 38 are provided for lifting a head portion (not shown).

The second pivotal connecting device 10 provided at the motor end of the adjusting drive is connected by means of its hinge connection 11 to a corresponding counterpart portion which is fixed to a stationary frame portion 12 of the article of furniture, wherein the hinge half of the pivotal connecting device 10 which is in the form of a fork head cooperates with the hinge half 16 carried on the frame portion 12.

In this example of installation it can be clearly seen that the dimension between the connecting pins which cooperate with the hinge halves 15 and 16 can be considerably decreased so that the known adjusting drive which in itself is of a relatively long structure can also be used for the movement kinematics for adjusting the head portion of beds. In this embodiment that is achieved in that the hinge halves 15 provided on the U-shaped loop 18 are displaced in the direction towards the central portion 17 of the guide tube 4.

Referring to FIG. 5 the U-shaped loop 22 is made from a bent steel plate. Welded to the inside surface of the base 19 of the U-shaped loop 18 is a projection 23 fixedly connected to the free end of the lift tube 5. In this embodiment the hinge halves 15 are in the form of simple eyes which cooperate with the hinge halves provided on the pivot fork 8 and which in this embodiment are in the form of pins. In this embodiment also the location of the hinge halves is displaced in the direction towards the central portion 17 of the guide tube 4 so that the dimension between the connecting pins is considerably reduced.

The embodiment shown in FIG. 6 is of a similar structure to the embodiment shown in FIG. 5. The only difference is that a tubular projection 26 is welded to the outside surface of the U-shaped loop 22 around a corresponding opening, the projection 26 being fitted on to the lift tube 5 and indirectly connected to the lift tube by way of any fixing element.

In the embodiment shown in FIG. 7 the U-shaped loop 22 comprises two loop halves 24 on which a respective half-shell portion 25 is shaped. The half-shell portions 25 embrace the free end of the lift tube 5 or an extension portion fixed thereto and are secured thereto by means of a transversely arranged screw.

In the embodiment shown in FIG. 8 the limbs 27 of the U-shaped loop 22 are pivotable relative to the base 19 about an axis extending transversely relative to the base 19 so that the adjusting drive can also be adapted to a remote movement mechanism.

In the embodiment shown in FIG. 9 the U-shaped loop 22 is again made from a bent sheet metal portion. The limbs 27 of the U-shaped loop 22 are in this case provided with lateral projections 28. The hinge halves 15 in the form of bores are arranged in this case on the projections 28 and are thus displaced out of the plane of the limbs 27.

In the embodiment shown in FIG. 10 the extension element 13 connected to the free end of the lift tube 5 is in the form of a pot 29, wherein the inside surface of the pot bottom is indirectly or directly connected to the free end of the lift tube 5.

In the embodiment shown in FIG. 11 a transverse yoke 30 is fixed to the free end of the lift tube 5, with a flexible cable 31 being guided around the yoke 30. In this case the ends of the cable 31 can be connected to the pivot fork 8 of the pivot shaft 9.

In this embodiment the ends of the cable 31 are in the form of loops which can be conveniently secured to the pivot fork 8 by means of suitable connecting elements.

In this arrangement the cable 31 is captively clipped to the yoke 30.

In the embodiment shown in FIG. 12 the extension element 14 is arranged at the side of the adjusting drive, that is remote from the free end of the lift tube 5, that is to say on the motor side. In that case the extension element is in the form of a U-shaped loop 32, the base 33 of which is fixed to the pivotal connecting device 10 at the motor side.

The limbs 34 of the U-shape extend on both sides of the guide tube 4 or the lift tube 5 parallel thereto. The hinge halves 15 which in the present case are in the form of bores are disposed in the region of the ends of the limbs 34 so that the dimension between the connecting pins can be considerably reduced, just as in the case of the above-described embodiments.

In the embodiment shown in FIG. 13 arranged at both ends of the adjusting drive at the pivotal connecting devices 6 and 7 thereof are corresponding extension elements 35, 36 which are in the form of shaped sheet metal parts. By virtue of this feature, namely providing extension elements 35 and 36 at both ends of the adjusting drive, the dimension between the connecting pins can be reduced to a minimum.

The invention claimed is:

1. A drive for adjusting parts of seating and lying furniture, wherein a first furniture component is mounted moveably relative to a second furniture component, comprising at least one spindle rotatable by way of an electric drive motor, an adjusting nut which is carried on the spindle and which guided non-rotatably in a guide tube and which is drivable by rotation of the spindle in the axial direction of the guide tube, a lift tube operatively connected to the adjusting nut, a first pivotal connecting device arranged at the free end of the lift tube and pivotally connectable to the first furniture component by way of a first hinge connection, and a second pivotal connecting device provided at the opposite end of the adjusting drive and fixable by way of a second hinge connection to a stationary frame portion or to a second furniture component, wherein at least one of the two pivotal connecting devices has an extension element fixedly connected thereto, a respective hinge half of the hinge connection is arranged at the extension element, and the hinge half which is carried at the respective extension element is displaced in the direction to the central portion of the guide tube.

2. A drive as set forth in claim 1 wherein the respective extension element is rigidly fixed to the pivotal connecting device.

3. A drive as set forth in claim 2 wherein the extension element is fixedly connected indirectly or directly to the free end of the lift tube.

4. A drive as set forth in claim 3 wherein the extension element is in the form of a U-shaped loop, the base of the loop is indirectly or directly fixed to the end of the lift tube, the limbs of the U-shape of the loop extend on both sides of the lift tube parallel thereto and the hinge halves are arranged in the region of the free ends of the limbs of the U-shape.

5. A drive as set forth in claim 4 wherein the U-shaped loop is in the form of a stable, multi-ribbed plastic portion or a cast metal portion.

6. A drive as set forth in claim 4 wherein the U-shaped loop comprises bent steel plate.

7. A drive as set forth in claim 6 wherein a pin is welded to the inside surface of the base of the U-shaped loop and is connected to the free end of the lift tube.

8. A drive as set forth in claim 6 wherein a tubular projection is welded to the outside surface of the U-shaped limb around an opening provided in the base of the U-shaped limb, which projection is fitted indirectly or directly on to the free end of the lift tube and is fixed thereto.

9. A drive as set forth in claim 4 wherein the U-shaped loop is formed from two halves, half-shell portions are shaped on the halves, and the half-shell portions are screwed indirectly or directly to the free end of the lift tube.

10. A drive as set forth in claim 6 wherein the limbs of the U-shaped loop are pivotable relative to the base about an axis extending transversely relative to the base.

11. A drive as set forth in claim 6 wherein the limbs of the U-shaped loop have lateral projections and the hinge halves are provided on the projections and are displaced out of the plane of the U-shaped loop.

12. A drive as set forth in claim 3 wherein the extension portion is in the form of a pot and the inside surface of the pot bottom is connected indirectly or directly to the free end of the lift tube.

13. A drive as set forth in claim 3 wherein a transverse yoke is fixed to the free end of the lift tube, a flexible cable is guided around the transverse yoke, and the ends of the cable can be connected to the ends of the pivot fork of the pivot shaft.

14. A drive as set forth in claim 1 wherein the extension element is arranged at the side of the adjusting drive, that is remote from the free end of the lift tube.

15. A drive as set forth in claim 14 wherein the extension element is in the form of a U-shaped loop, the base of the U-shaped loop is fixed to the pivotal connecting device, the limbs of the U-shape extend on both sides of the lift tube parallel thereto and the hinge halves are arranged in the region of the free end of the limbs of the U-shape.

16. A drive as set forth in claim 1 wherein arranged at both ends of the adjusting drive at its pivotal connecting devices are corresponding extension elements.

* * * * *